US005174727A

United States Patent [19]

Terauchi et al.

[11] Patent Number: 5,174,727

[45] Date of Patent: Dec. 29, 1992

[54] SLANT PLATE TYPE COMPRESSOR WITH VARIABLE DISPLACEMENT MECHANISM

[75] Inventors: Kiyoshi Terauchi, Isesaki; Shigemi Shimizu, Sakai; Kazuhiko Takai, Maebashi, all of Japan

[73] Assignee: Sanden Corporation, Gunma, Japan

[21] Appl. No.: 870,762

[22] Filed: Apr. 20, 1992

Related U.S. Application Data

[63] Continuation of Ser. No. 639,729, Jan. 10, 1991, abandoned, which is a continuation of Ser. No. 277,998, Nov. 29, 1988, abandoned.

[30] Foreign Application Priority Data

Nov. 30, 1987 [JP] Japan ..... 62-303050

[51] Int. Cl.[5] ..... F04B 1/26

[52] U.S. Cl. ..... 417/222.1; 417/270; 417/222.2

[58] Field of Search ..... 417/222, 222 S, 270, 417/269

[56] References Cited

U.S. PATENT DOCUMENTS

| | | | |
|---|---|---|---|
| 4,428,718 | 1/1984 | Skinner | 417/222 S |
| 4,664,604 | 5/1987 | Terauchi | 417/222 S |
| 4,685,866 | 8/1987 | Takenaka et al. | 417/222 S |
| 4,688,997 | 8/1987 | Suzuki et al. | 417/270 X |
| 4,752,189 | 6/1988 | Bearint et al. | 417/222 S |

*Primary Examiner*—Richard A. Bertsch
*Assistant Examiner*—Peter Korytnyk
*Attorney, Agent, or Firm*—Baker & Botts

[57] ABSTRACT

A slant plate type compressor including a compressor housing having a cylinder block is disclosed. A plurality of cylinders are formed around the periphery of the cylinder block and a piston is slidably fitted within each of the cylinders and is reciprocated by a drive mechanism. A crank chamber is formed between the cylinder block and a front end plate of the compressor housing. The drive mechanism includes a drive shaft rotatably supported in the compressor housing, a rotor coupled to the drive shaft and rotatable therewith, and a coupling mechanism for drivingly coupling the rotor to the pistons such that they rotary motion of the rotor is converted into reciprocating motion of the pistons. The coupling mechanism includes a plate having a surface disposed at a slant angle relative to the drive shaft. The slant angle changes in response to a change in pressure in the crank chamber to change the capacity of the compressor. The compressor housing includes a rear end plate including suction and discharge chambers. A communication path communicates the crank chamber and the suction chamber. A valve control mechanism controls the opening and closing of the communication path to cause a change in pressure in the crank chamber. A flow control mechanism formed in the cylinder block admits reduced discharge gas pressure to the crank chamber from the discharge chamber to control the crank chamber pressure which controls the slant angle of the slant plate.

9 Claims, 2 Drawing Sheets

SLANT PLATE TYPE COMPRESSOR WITH VARIABLE DISPLACEMENT MECHANISM

This application is a continuation of application Ser. No. 07/639,729 filed Jan. 10, 1991 which is a continuation of 07/277,998 filed Nov. 29, 1988, both now abandoned.

BACKGROUND OF THE INVENTION

1. Field Of The Invention

The present invention generally relates to a refrigerant compressor and, more particularly, to a slant plate type compressor, such as a wobble plate type compressor, with a variable displacement mechanism suitable for use in an automotive air conditioning system.

2. Description Of The Prior Art

A wobble plate type compressor with a variable displacement mechanism suitable for use in an automotive air conditioning system is disclosed in U.S. Pat. No. 3,861,829 issued to Roberts et al. As disclosed therein, the compression ratio of the compressor may be controlled by changing the slant angle of the sloping surface of the wobble plate. The slant angle of the wobble plate is adjusted so as to maintain a constant suction pressure in response to changes in the pressure differential between the suction chamber and the crank chamber. The difference in pressure between the suction chamber and the crank chamber is generated by a valve control mechanism which controls communication between the suction chamber and the crank chamber. The valve control mechanism varies the crank chamber pressure in response to the suction chamber pressure. In this prior art technique, the crank chamber pressure which generates the changes in the slant angle of the wobble plate is obtained by compressed refrigerant gas which passes through a gap between the cylinder and the piston. This gap is due to the use of a cast iron piston ring disposed at an outer peripheral surface of an aluminum alloy piston housed within a cast iron lined cylinder.

Recently, however, cylinder blocks have been formed of aluminum alloys in order to reduce the weight of the compressor. A seamless piston ring made of polytetrafluoroethylene resin has been disposed at an outer peripheral surface of the piston to prevent wear of both the piston and the cylinder block due to friction therebetween. However, the piston rings enlarge due to swelling during use, thereby significantly reducing the amount of compressed refrigerant gas which is passed to the crank chamber. It is therefore difficult to obtain a crank chamber pressure which satisfactorily generates appropriate changes in the slant angle of the wobble plate. This difficulty is compounded with the use of two of the above-mentioned piston rings, one of which is disposed at an upper portion of the piston and the other of which is disposed at a lower portion of the piston so as to prevent direct contact between the piston and an inner surface of the cylinder.

To overcome this difficulty, U.S. patent application Ser. No. 068,580 filed July 1, 1987 discloses a polytetrafluoroethylene resin made piston ring having a plurality of axial cut-out portions. However, the depth of axial cut-out portions of the piston ring is gradually reduced due to the swelling of the piston ring. Again, it becomes difficult to generate a crank chamber pressure which satisfactorily generates the appropriate changes in the slant angle of the wobble plate throughout the useful life of the compressor.

U.S. Pat. No. 4,428,718 discloses a valve control mechanism responsive to both suction and discharge pressures which controls communication of these pressures with the compressor crank chamber to control compressor displacement. However, extremely precise machining of the component parts and accurate assembly thereof are required. Moreover, when the heat load of the evaporator or the rotation speed of the compressor is changed quickly, an increased amount of discharge gas flows into the crank chamber through a communication passage of the valve control mechanism due to a lag between the action of the valve control mechanism and the response of the external circuit including the compressor. As a result of the increased discharge gas flow, the efficiency of the compressor decreases and the durability of the compressor components is reduced.

The type of capacity adjustment described above using fluid communication between the discharge chamber and the crank chamber may be used in any type of compressor which uses a slanted plate or surface in the drive mechanism. For example, U.S. Pat. No. 4,664,604 to Terauchi discloses a swash plate type compressor. The swash plate, like the wobble plate, is disposed at a slant angle and drivingly couples the pistons to the drive source. However, while the wobble plate only nutates, the swash plate both nutates and rotates. The term slant plate type compressor will therefore be used herein to refer to any type of compressor, including wobble and swash plate types, which use a slanted plate or surface in the drive mechanism.

SUMMARY OF THE INVENTION

Accordingly, it is an object of this invention to provide a variable capacity slant plate type compressor which generates the appropriate changes in the slant angle of the slant plate.

The slant plate type compressor in accordance with the present invention includes a compressor housing having a cylinder block with a front end plate and a rear end plate attached thereto. A crank chamber is defined between the front end plate and the cylinder block and a plurality of cylinders are formed in the cylinder block. A piston is slidably fitted within each of the cylinders. A drive mechanism is coupled to the pistons to reciprocate the pistons within the cylinders. The drive mechanism includes a drive shaft rotatably supported in the compressor housing, a rotor coupled to the drive shaft and rotatable therewith, and a coupling mechanism for drivingly coupling the rotor to the pistons such that they rotary motion of the rotor is converted into reciprocating motion of the pistons. The coupling mechanism includes a plate having a surface disposed at a slant angle relative to the drive shaft. The slant angle changes in response to a change in pressure in the crank chamber to change the capacity of the compressor.

The rear end plate includes a suction chamber and a discharge chamber defined therein. A first communication path links the crank chamber with the suction chamber. A valve control mechanism controls the opening and closing of the communication path to generate changes in pressure in the crank chamber. A second communication path formed in the cylinder block links the crank chamber with the discharge chamber. A flow control mechanism formed in the second communication path controls the flow of refrigerant gas from the discharge chamber to the crank chamber. The flow control mechanism includes a mechanism for reducing the pressure of refrigerant gas which flows from the discharge chamber to the crank chamber in order to control the slant angle of the slant plate.

BRIEF DESCRIPTION OF THE DRAWINGS

A more complete appreciation of the present invention and many of the attendant advantages thereof will be readily obtained as the invention becomes better understood from the following detailed description with reference to the attached drawings.

DETAILED DESCRIPTION OF THE EMBODIMENTS

Although the present invention is described below in terms of a wobble plate type compressor, it is not limited in this respect. The present invention is broadly applicable to slant plate type compressors.

Figure 1:
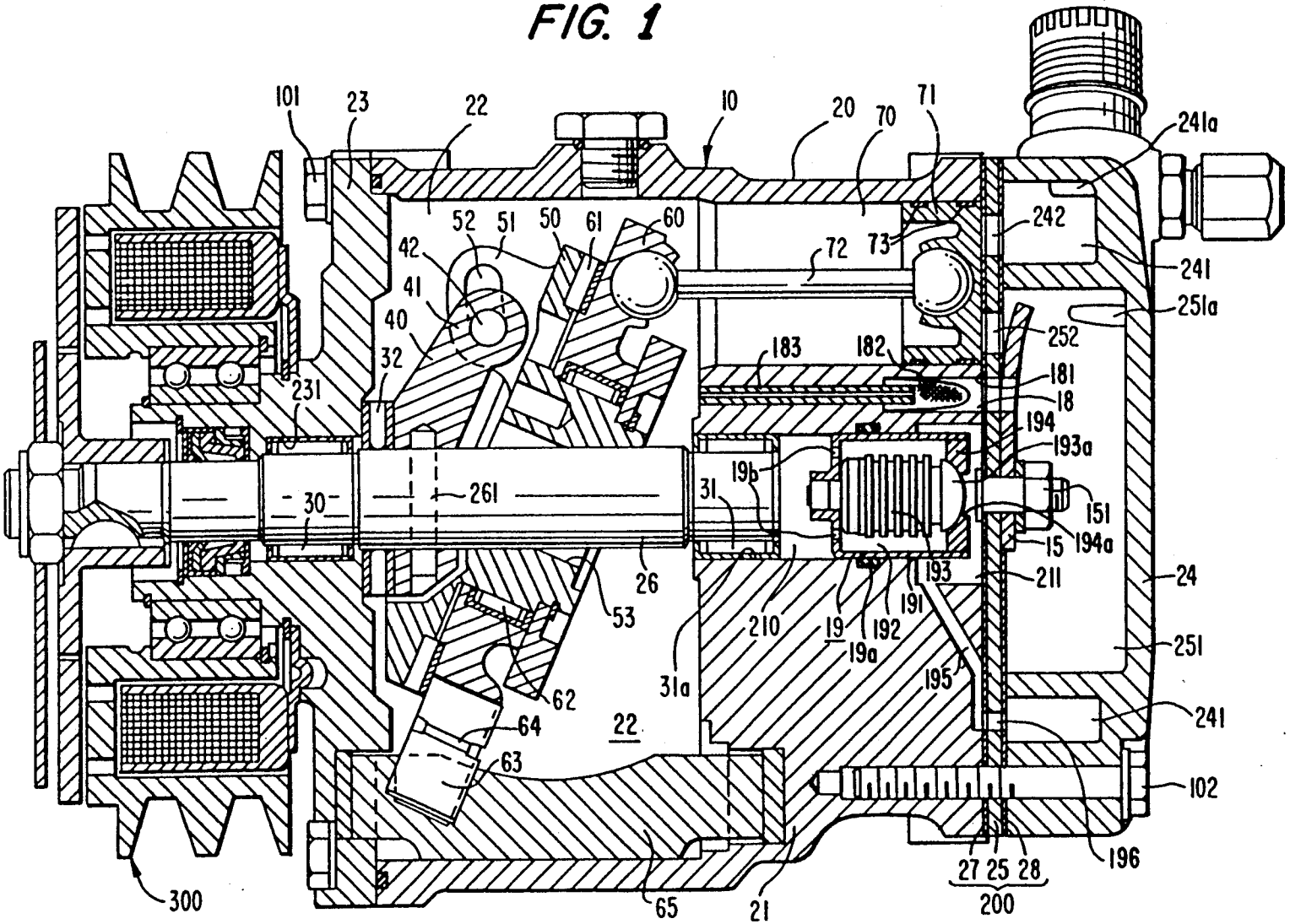
FIG. 1 is a sectional view of a wobble plate type refrigerant compressor in accordance with a first embodiment of this invention.

A wobble plate type refrigerant compressor in accordance with one embodiment of the present invention is shown in FIG. 1. Compressor 10 includes cylindrical housing assembly 20 including cylinder block 21, front end plate 23 disposed at one end of cylinder block 21, crank chamber 22 formed between cylinder block 21 and front end plate 23, and rear end plate 24 attached to the other end of cylinder block 21. Front end plate 23 is secured to one end of cylinder block 21 by a plurality of bolts 101. Rear end plate 24 is secured to the opposite end of cylinder block 21 by a plurality of bolts 102. Valve plate 25 is disposed between rear end plate 24 and cylinder block 21. Opening 231 is formed centrally in front end plate 23 for supporting drive shaft 26 through bearing 30 disposed therein. The inner end portion of drive shaft 26 is rotatably supported by bearing 31 disposed within central bore 210 of cylinder block 21. Bore 210 extends to a rearward (to the right in FIG. 1) end surface of cylinder block 21 and houses valve control mechanism 19 described in detail below.

Cam rotor 40 is fixed on drive shaft 26 by pin member 261 and rotates therewith. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is disposed adjacent cam rotor 40 and includes opening 53 through which drive shaft 26 passes. Slant plate 50 includes arm 51 having slot 52. Cam rotor 40 and slant plate 50 are coupled by pin member 42 which is inserted in slot 52 to form a hinged joint. Pin member 42 slides within slot 52 to allow adjustment of the angular position of slant plate 50 with respect to the longitudinal axis of drive shaft 26.

Wobble plate 60 is rotatably mounted on slant plate 50 through bearings 61 and 62. Fork shaped slider 63 is attached to the outer peripheral end of wobble plate 60 by pin member 64 and is slidably mounted on sliding rail 65 disposed between front end plate 23 and cylinder block 21. Fork shaped slider 63 prevents rotation of wobble plate 60. Wobble plate 60 nutates along rail 65 when cam rotor 40 rotates. Cylinder block 21 includes a plurality of peripheral located cylinder chambers 70 in which pistons 71 reciprocate. Each piston 71 is coupled to wobble plate 60 by a corresponding connecting rod 72.

A pair of seamless piston rings 73 made of polytetrafluoroethylene is disposed at an outer peripheral surface of piston 71. Piston rings 73 prevent the wear of both aluminum alloy piston 71 and aluminum alloy cylinder block 21 due to friction therebetween and prevent any direct contact between piston 71 and the inner surface of cylinder 70.

Rear end plate 24 includes peripherally positioned annular suction chamber 241 and centrally positioned discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu.

Suction chamber 241 includes inlet port **241*a* which is connected to an evaporator of an external cooling circuit (not shown). Discharge chamber 251 is provided with outlet portion 251*a* connected to a condenser of the cooling circuit (not shown). Gaskets 27 and 28 are positioned between cylinder block 21 and the inner surface of valve plate 25 and the outer surface of valve plate 25 and rear end plate 24 respectively. Gaskets 27 and 28 seal the mating surfaces of cylinder block 21, valve plate 25 and rear end plate 24**.

A first communication path between the crank chamber and the suction chamber is formed in the cylinder block. This first communication path includes valve control mechanism 19 which includes cup-shaped casting member 191 which defines valve chamber 192 therein. O-ring **19*a* is disposed between an outer surface of casing member 191 and an inner surface of bore 210 to seal the mating surface of casting member 191 and cylinder block 21. A plurality of holes 19*b* is formed at the closed end (to the left in FIG. 1) of cup-shaped casing member 191 to permit crank chamber pressure into valve chamber 192 through gap 31*a* existing between bearing 31 and cylinder block 21. Circular plate 194 having hole 194*a* formed at the center thereof is fixed to the open end of cup-shaped casing member 191. Bellows 193 is disposed within valve chamber 192 and contracts and expands longitudinally in response to the crank chamber pressure. The forward (to the left in FIG. 1) end of bellows 193 is fixed to the closed end of casing member 191. Valve member 193*a* is attached at rearward (to the right in FIG. 1) end of bellows 193 to selectively control the opening and closing of hole 194*a*. Valve chamber 192 and suction chamber 241 are linked by hole 194*a*, bore portion 211 of bore 210, conduit 195 formed in cylinder block 21 and hole 196 formed valve plate assembly 200. Valve plate assembly 200 includes valve plate 25 and gaskets 27 and 28. Valve retainer 15 is secured to the rear end surface of valve plate assembly 200 by bolt 151**.

Communication path 18, which is bored longitudinally from a forward end surface of cylinder block 21 to a rear end surface of valve retainer 15, is a second communication path formed in the cylinder block to link discharge chamber 251 to crank chamber 22. Communication path 18 controls the flow of refrigerant gas from discharge chamber 251 to crank chamber 22. Large diameter conduit portion 181 of communication path 18 has filter screen 182 disposed therein. Capillary tube 183, which performs a throttling function to reduce the pressure of refrigerant gas passing from discharge chamber 251 to crank chamber 22, is fixed within communication path 18 and is coupled to filter screen 182.

During operation of compressor 10, drive shaft 26 is rotated by the engine of the vehicle (not shown) through electromagnetic clutch 300. Cam rotor 40 is rotated with drive shaft 26 causing slant plate 50 to rotate. The rotation of slant plate 50 causes wobble plate 60 to nutate. The nutating motion of wobble plate 60 reciprocates pistons 71 in their respective cylinders 70. As pistons 71 are reciprocated, refrigerant gas which is introduced into suction chamber 241 through inlet portion 241*a* is drawn into cylinders 70 through suction ports 242 and subsequently compressed. The compressed refrigerant gas is discharged from cylinders 70 to discharge chamber 251 through respective discharge ports 252 and then into the cooling circuit through outlet portion 251*a*. A portion of the discharged refrigerant gas in discharge chamber 251 flows into crank chamber 22 through conduit 18 with a reduced pressure generated by capillary tube 183.

Valve control mechanism 19 is responsive to the reduced discharge gas pressure in crank chamber 22. When the reduced discharge gas pressure in crank chamber 22 exceeds a predetermined value, hole 194*a* is opened by the contraction of bellows 193. The opening of hole 194*a* permits communication between crank chamber 22 and suction chamber 241. As a result, the slant angle of slant plate 50 is maximized to maximized the displacement of the compressor. However, when the reduced discharge gas pressure in crank chamber 22 is less than the predetermined value, hole 194*a* is closed by valve member 193*a* attached to bellows 193. This action blocks communication between crank chamber 22 and suction chamber 241. As a result, the slant angle of slant plate 50 is controlled by changes in the reduced discharge gas pressure admitted to crank chamber 22 via communication path 18 to vary the displacement of the compressor.

Figure 2:
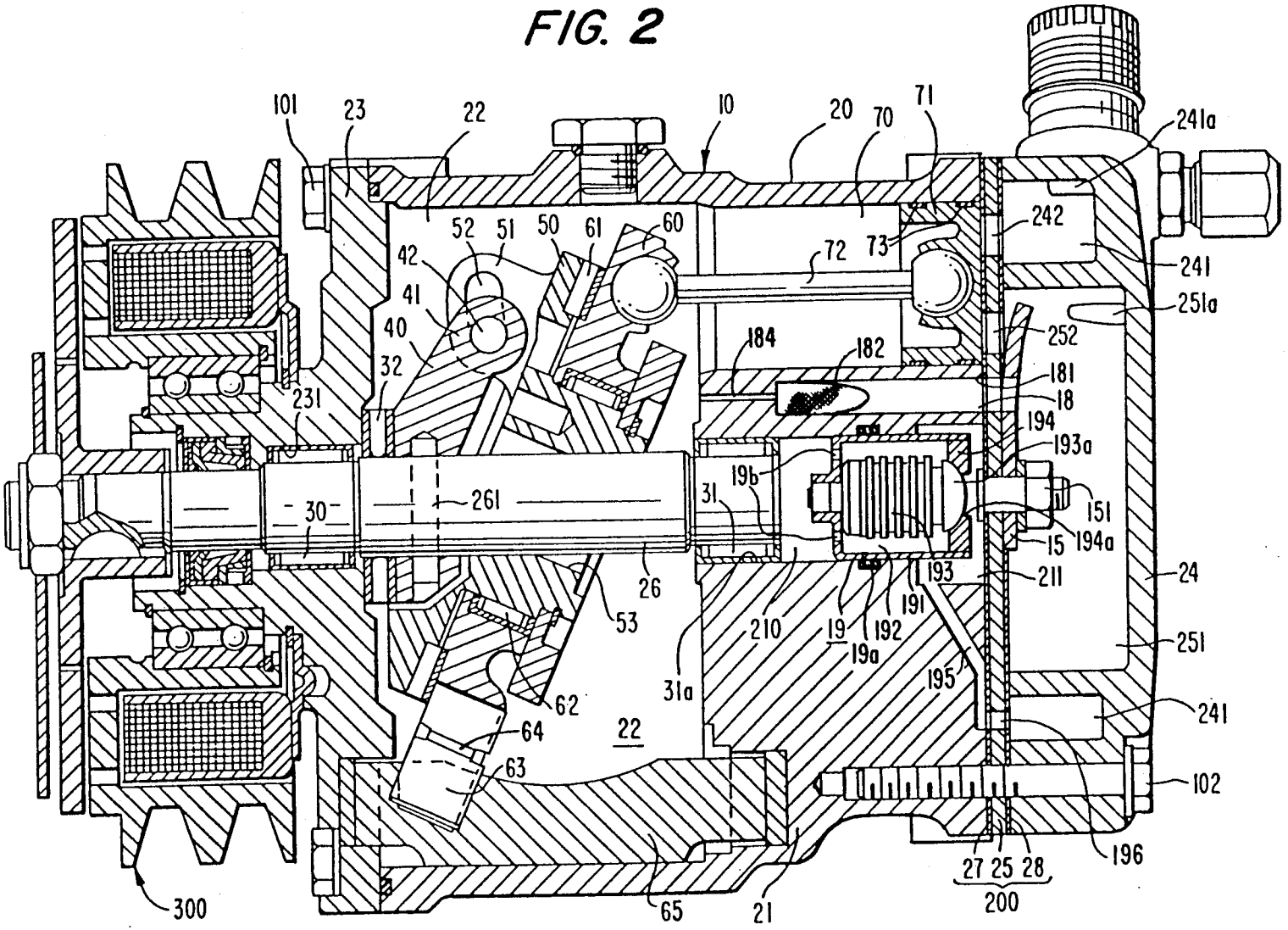
FIG. 2 is a sectional view of a wobble plate type refrigerant compressor in accordance with a second embodiment of this invention.

FIG. 2 illustrates a second embodiment of the present invention in which the same numerals are used to denote the corresponding elements shown in FIG. 1. In this embodiment, a small diameter narrowed portion 184 of communication path 18 performs the throttling function to reduce the pressure of discharge refrigerant gas admitted to crank chamber 22.

The pressure reduction (decompression) generated as the refrigerant gas flows from discharge chamber 251 to crank chamber 22 through communication path 18 is determined by the inner diameter and length of capillary tube 183 or narrowed portion 184. Thus, the amount of decompression desired may be fixed through the choice of these dimensions.

It can be seen that the provision of a communication path in the cylinder block for controlling the flow of refrigerant gas from the discharge chamber to the crank chamber provides a simple and effective mechanism for controlling the pressure within the crank chamber to control the slant angle of the slant plate. In addition, the mechanism is effective throughout the operating lifetime of the compressor and is not subject to problems such as the swelling of the piston rings.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the claims.

We claim:

1. In a slant plate type compressor for use in a refrigeration circuit, said compressor including a compressor housing having a cylinder block provided with a plurality of cylinders a front end plate disposed on one end of said cylinder block and enclosing a crank chamber within said cylinder block, a piston slidably fitted within each of said cylinders, each piston having at least one piston ring thereon, a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a plate having a surface disposed at a slant angle relative to said drive shaft, said slant angle changing in response to a change in pressure in said crank chamber to change the capacity of said compressor, a rear end plate disposed on the opposite side of said cylinder block from said front end plate and defining a suction chamber and a discharge chamber therein, a communication path linking said crank chamber with said suction chamber, and a valve control means for controlling the opening and closing of said communication path to cause in pressure in said crank chamber, an improvement comprising:

means for compensating for a reduction in blow by gas due to swollen piston rings;

wherein said compensating means comprises flow control means formed in said cylinder block for controlling the flow of refrigerant gas from said discharge chamber to said crank chamber, said flow control means providing continuous communication between said discharge chamber and said crank chamber and further including throttling means for throttling refrigerant gas flowing therethrough so as to reduce the pressure of refrigerant gas which flows from said discharge chamber to said crank chamber in order to generate a pressure within said crank chamber which controls the slant angle of said plate, said throttling means continuously throttling said discharge pressure to said crank chamber regardless of the amount of pressure in said discharge chamber.

2. The improved refrigerant compressor of claim 1 wherein said flow control means comprises a conduit including a capillary tube disposed therein.

3. The improved refrigerant compressor of claim 2 further comprising a filter screen disposed within said conduit.

4. The improved refrigerant compressor of claim 1 wherein said flow control means comprises a conduit including a small diameter portion therein.

5. A slate plate type compressor for use in a refrigeration circuit, said compressor comprising:

a compressor housing having a cylinder block provided with a plurality of cylinders;

a front end plate disposed on one end of said cylinder block and enclosing a crank chamber within said cylinder block;

a piston slidably fitted within each of said cylinders, each piston having at least one piston ring thereon;

a drive mechanism coupled to said pistons to reciprocate said pistons within said cylinders, said drive mechanism including a drive shaft rotatably supported in said housing, a rotor coupled to said drive shaft and rotatable therewith, and coupling means including a plate having a surface disposed at a slant angle relative to said drive shaft, said slant angle changing in response to a change in pressure in said crank chamber to change the capacity of said compressor;

a rear end plate disposed on the opposite side of said cylinder block from said front end plate and defining a suction chamber and a discharge chamber therein;

a communication path linking said crank chamber with said suction chamber;

valve control means for controlling the opening and closing of said communication path to cause a change in pressure in said crank chamber;

means for compensating for a reduction in blow by gas due to swollen piston rings;

wherein said compensating means comprises flow control means formed in said cylinder block for controlling the flow of refrigerant gas from said discharge chamber to said crank chamber, said flow control means providing continuous communication between said discharge chamber and said crank chamber and further including throttling means for throttling refrigerant gas flowing therethrough to said crank chamber in order to generate a pressure within said crank chamber which controls the slant of said plate, said throttling means continuously throttling said discharge pressure to said crank chamber regardless of the amount of pressure in said discharge chamber.

6. The refrigerant compressor of claim 5 wherein said flow control means comprises a conduit including a capillary tube disposed therein.

7. The refrigerant compressor of claim 6, further comprising filter means for filtering refrigerant gas flowing therethrough, wherein said filter means comprises a filter screen disposed within said conduit.

8. The refrigerant compressor of claim 5 wherein said flow control means comprises a conduit including a first portion having a first diameter and a second portion having a second diameter smaller than the first diameter.

9. The refrigerant compressor of claim 8, further comprising filter means for filtering refrigerant gas flowing therethrough, wherein said filter means comprises a filter screen disposed within said conduit.

* * * * *